United States Patent [19]

Hartley

[11] 4,305,702

[45] Dec. 15, 1981

[54] PUMP WITH EXPANDABLE CHAMBER

[76] Inventor: E. Dale Hartley, 1706 Decker Rd., Malibu, Calif. 90265

[21] Appl. No.: 76,343

[22] Filed: Sep. 17, 1979

[51] Int. Cl.[3] ..... F04B 43/02; F04B 45/04

[52] U.S. Cl. ..... 417/413; 417/542; 417/560; 417/566

[58] Field of Search ..... 417/560, 413, 540–544, 417/566

[56] References Cited

U.S. PATENT DOCUMENTS

| | | | |
|---|---|---|---|
| 2,929,333 | 3/1960 | Harry | 417/542 |
| 3,205,829 | 9/1965 | Andersen et al. | 417/542 |
| 3,496,872 | 2/1970 | Riester et al. | 417/413 X |
| 3,572,980 | 3/1971 | Hollyday | 417/413 |
| 3,606,597 | 9/1971 | Russell | 417/542 |
| 3,941,519 | 3/1976 | McCauley | 417/560 |

*Primary Examiner*—Carlton R. Croyle
*Assistant Examiner*—Edward Look
*Attorney, Agent, or Firm*—Gordon L. Peterson

[57] ABSTRACT

A pump for pumping an incompressible liquid comprising a housing having an inlet and an outlet, a pumping chamber in said housing, and a positive displacement pumping member mounted for movement in the pumping chamber. The housing has an inlet passage which leads from the inlet to the pumping chamber and an outlet passage leading from the pumping chamber to the outlet. Inlet and outlet check valves are provided in the inlet and outlet passages, respectively. A resiliently expandable chamber opens into the inlet passage upstream of the inlet check valve to receive the liquid and to be resiliently expanded by it.

9 Claims, 6 Drawing Figures

PUMP WITH EXPANDABLE CHAMBER

BACKGROUND OF THE INVENTION

A typical positive displacement pump includes a housing having an inlet and an outlet, a pumping chamber in the housing and a positive displacement pumping member mounted for movement in the pumping chamber. The housing has an inlet passage leading from the inlet to the pumping chamber and an outlet passage leading from the pumping chamber to the outlet. Inlet and outlet check valves are provided in the inlet and outlet passages, respectively. The positive displacement pumping member which may include, for example, a diaphragm, a piston, an eccentrically driven roller, etc., is rapidly driven through intake and discharge strokes to pump a fluid from the inlet to the outlet of the pump.

One problem with pumps of this kind occurs when the pump is used to pump an incompressible fluid and it is driven by a motor, such as an electromagnetic actuator, at a high rate of speed. For example, the pump may be used to pump an incompressible liquid, such as water, and be driven through 60 cycles, i.e., 60 intake and 60 discharge strokes, per second. On each intake stroke, the incompressible liquid must flow in the line through the inlet and into the pumping chamber and, on each discharge stroke, the flow of water from the inlet to the pumping chamber is terminated. For a pump being driven at 60 cycles per second, this means that the water flow to the pump must be stopped and started 60 times each second. The inertia of the moving column of water is such that the water column cannot be stopped and started at that rate, and this can result in incomplete filling of the pumping chamber on the intake stroke and consequent reduction in pumping capacity.

SUMMARY OF THE INVENTION

This invention provides a positive displacement pump which is not starved when pumping an incompressible liquid and when being driven at high speeds, such as 60 cycles per second. This is accomplished by providing a resiliently expandable chamber which opens into the inlet passage upstream of the inlet check valve. On the intake stroke, the inlet check valve is open, and the incompressible liquid flows into the pumping chamber from the inlet and the expandable chamber. When the pump begins its discharge stroke and the inlet check valve closes, the inertia of the incompressible liquid at the inlet continues to carry the liquid into the expandable chamber to resiliently expand the chamber. When the next intake stroke commences, the expandable chamber resiliently returns to its normal size and, in so doing, provides liquid under pressure to the pumping chamber. This assures that the pumping chamber will be adequately filled on the intake stroke.

Although the expandable chamber can be placed at many different locations upstream of the check valve, it preferably opens into the inlet passage closely adjacent the inlet check valve. By locating the expandable chamber close to the inlet check valve, the water has a shorter distance to travel to reach the pumping chamber. To provide additional insurance that the pumping chamber will adequately fill on the intake stroke, one or more of the expandable chambers can be provided adjacent the inlet check valve.

High-speed operation of a positive displacement pump pumping an incompressible liquid characteristically provides pulses of the liquid into the discharge line. This invention also utilizes a second expandable chamber opening into the outlet passage downstream of the check valve to receive liquid on the discharge stroke and to be resiliently expanded by such liquid. When the outlet check valve closes, the expandable chamber can return toward its unstressed condition and, in so doing, force some of the incompressible liquid from it into the discharge line. This tends to maintain a more even discharge pressure.

Although each of the resilient, expandable chambers can take different forms, preferably, the housing has a cavity therein and a diaphragm extends across the cavity to divide the cavity into at least the expandable chamber and one or more associated sealed chambers. The sealed chamber has a compressible gas therein so that the diaphragm can be deformed against the compressible gas in the sealed chamber to permit the resilient expansion of the expandable chamber.

In a preferred construction, the housing includes first and second housing sections. A flexible diaphragm is sandwiched between the housing sections. The housing has a number of cavities corresponding to the number of expandable chambers desired. The diaphragm extends across the cavities to divide each of the cavities into an expandable chamber, one or more associated sealed chambers, and a portion of the inlet and outlet passages. A second portion of the diaphragm can advantageously be used to seal the interface between the housing sections and to seal the various chambers from each other. If desired, a third portion of the diaphragm may be utilized to form all, or a portion of, the pumping member. With this construction, a single diaphragm performs several important functions, and the expandable chambers are located closely adjacent the associated check valve.

Each of the check valves includes a valve seat. The diaphragm may also be utilized to mount the valve seat. For this purpose, at least one projection and at least one recess are provided on the diaphragm and the valve seat with the projection being received in the recess to accomplish the valve seat mounting function.

Although the pump of this invention can be driven by many different power sources, it is particularly adapted for being driven by a high-speed driving source, such as an electromagnetic actuator. For this purpose, a shaft is coupled to the positive displacement pumping member and extends out an opening in the pumping chamber. The shaft and the opening are preferably of non-circular configuration so as to prevent rotation of the shaft relative to the pump housing.

The invention, together with further features and advantages thereof, may best be understood by reference to the following description taken in connection with the accompanying illustrative drawing.

DESCRIPTION OF THE PREFERRED EMBODIMENT

Figure 1:
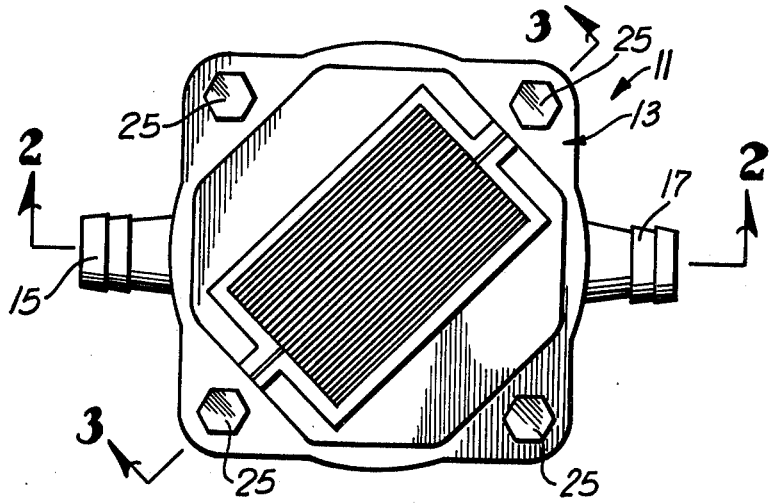
FIG. 1 is a top plan view of a pump constructed in accordance with the teachings of this invention.
Figure 2:
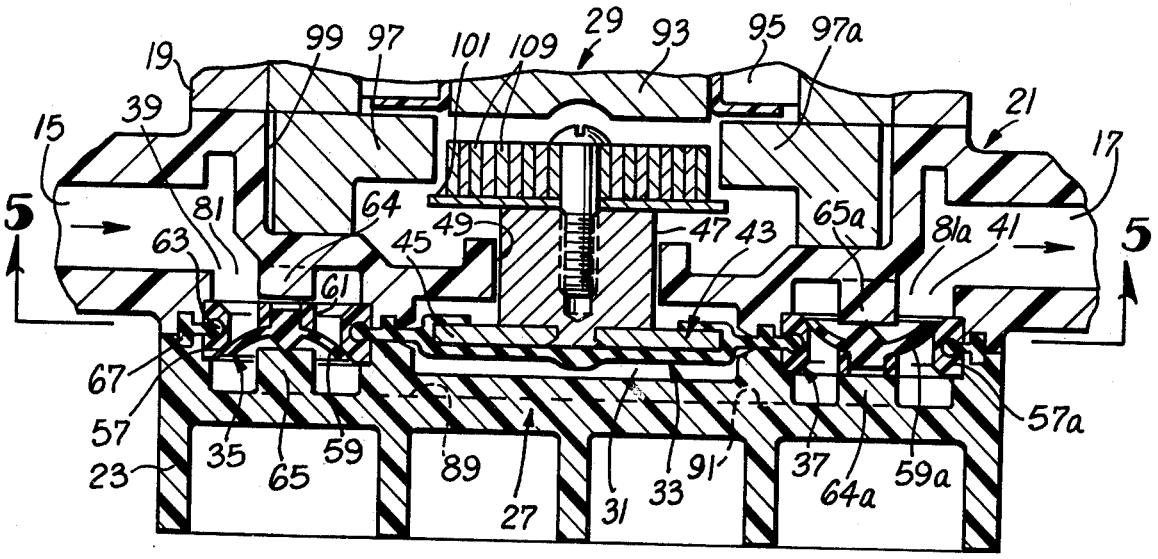
FIG. 2 is an enlarged fragmentary sectional view taken generally along line 2—2 of FIG. 1 with the pump not operating.
Figure 3:
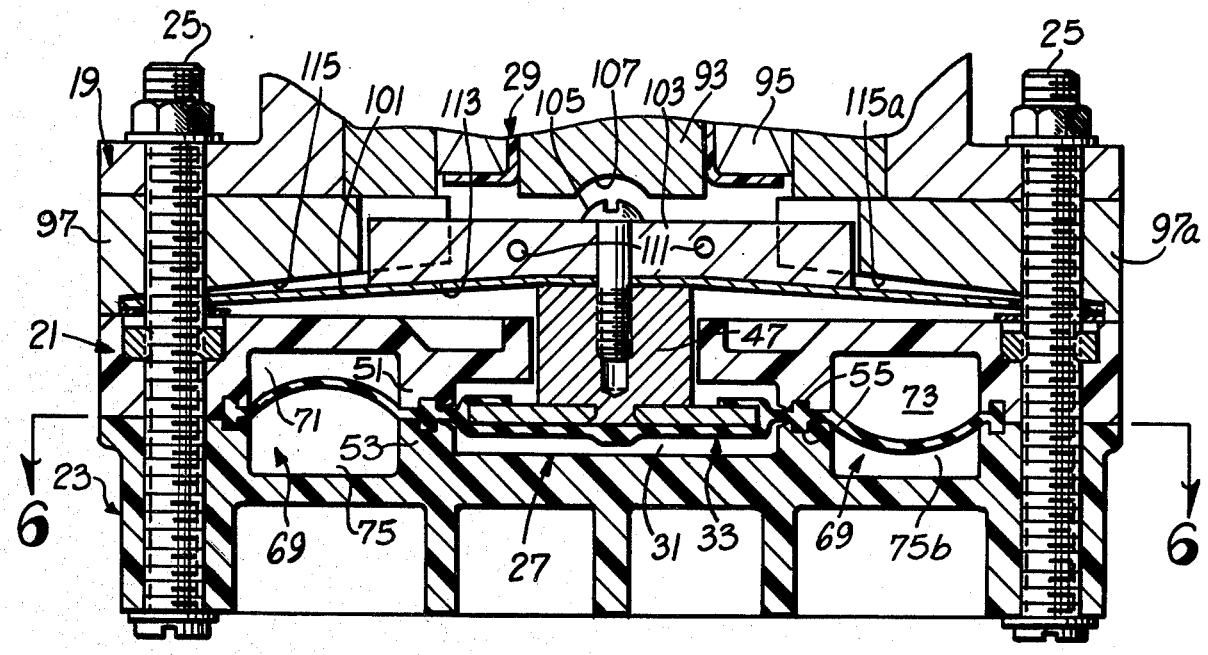
FIG. 3 is an enlarged fragmentary sectional view taken generally along line 3—3 of FIG. 1 with the pump not operating.

FIG. 1 shows a pump assembly 11 which generally includes a housing 13, an inlet 15 and an outlet 17. With reference to FIGS. 2 and 3, the housing 13 includes a heat sink 19 and molded plastic housing sections 21 and 23 held together by a plurality (four being illustrated) of threaded fasteners 25.

The pump assembly 11 includes a pump 27 and a motor in the form of an actuator 29. Although the pump 27 is described in the description of the specific embodiment as pumping water, it should be understood that it can be used to pump other fluids. However, the pump 27 is particularly adapted for pumping substantially incompressible liquids.

The pump 27 includes a pumping chamber 31 (FIGS. 2 and 3), a diaphragm 33 sandwiched between the housing sections 21 and 23, an inlet check valve 35, an outlet check valve 37, an inlet passage 39 leading from the inlet 15 to the pumping chamber 31, an outlet passage 41 leading from the pumping chamber 31 to the outlet 17 and a positive displacement pumping member 43. The pumping member 43 includes a central section of the diaphragm 33 and a flat, rigid disc 45 carried by the diaphragm to provide it with adequate rigidity. The disc 45 is coupled to a square shaft 47 which projects through a correspondingly configured square opening 49 of the housing section 21 to prevent rotation of the pumping member 43 relative to the housing 13.

Figure 5:
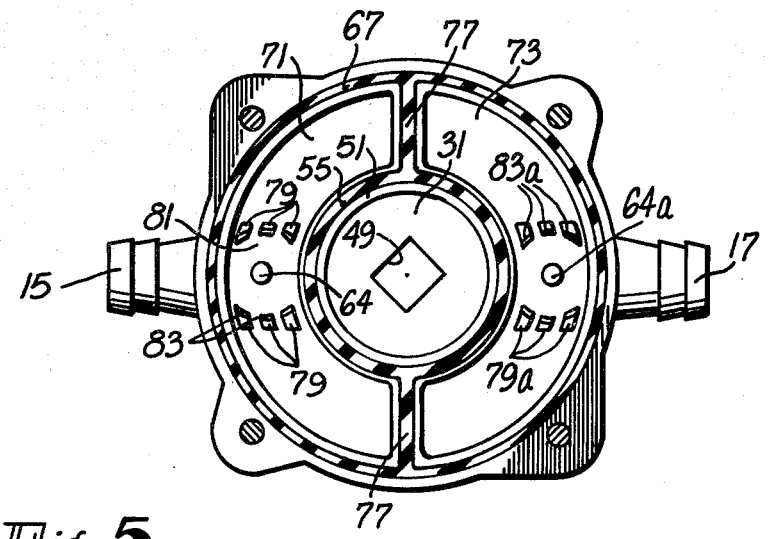
FIG. 5 is a sectional view taken generally along line 5—5 of FIG. 2 with portions removed.

The pumping chamber 31 is defined by annular walls 51 (FIGS. 3 and 6) and 53 (FIGS. 3 and 5). An annular sealing bead 55 (FIG. 5) formed integrally with the diaphragm 33 cooperates with a groove in the annular wall 51 to seal the upper portion of the pumping chamber 31. A nearly annular sealing bead 56 (FIG. 6) which is also integral with the diaphragm 33 cooperates with a groove in the annular wall 53 to seal the lower region of the pumping chamber 31 from all adjacent regions of the pump, except for the check valves 35 and 37.

The inlet check valve 35 includes a valve seat 57 which is preferably constructed from a relatively hard material and a resilient curved valve element 59 which is constructed of a flexible resilient material, such as rubber. The valve element 59 is mounted on a central segment 61 of the valve seat 57, and the valve seat 57 is in turn mounted on an annular mounting rib 63 of the diaphragm 33 which is insertable into an annular mating groove formed on the peripheral surface of the valve seat. The housing sections 21 and 23 have posts 64 and 65, respectively, which engage opposite central regions of the valve element 59.

The outlet check valve 37 is identical to the inlet check valve, and portions of the outlet check valve corresponding to portions of the inlet check valve are designated by corresponding reference numerals followed by the letter "a". One difference between the check valves 35 and 37 is that they face in different directions as viewed in FIG. 2, and the posts 64*a* and 65*a* are provided on the housing sections 23 and 21, respectively. The posts 65 and 65*a* are longer than the posts 64 and 64*a* and this prevents incorrect installation of the check valve by inserting either or both of the check valves upside down from the orientation shown in FIG. 2.

Figure 6:
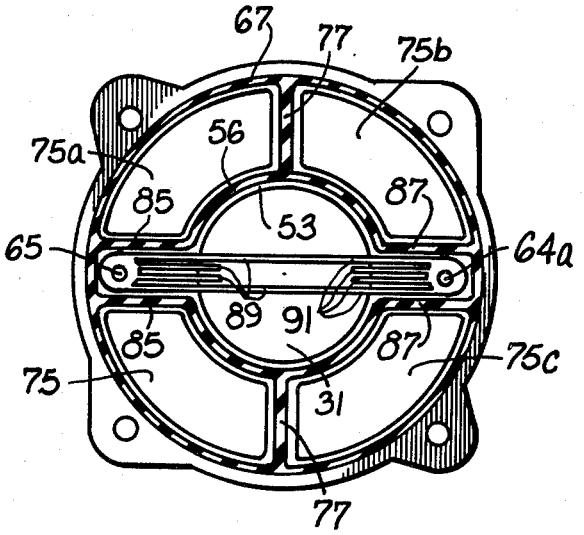
FIG. 6 is a sectional view taken generally along line 6—6 of FIG. 3 with portions removed.

To seal the housing sections 21 and 23, the diaphragm 33 has an outer peripheral annular bead 67 (FIGS. 2, 5 and 6). As shown in FIG. 3, the housing sections 21 and 23 cooperate to define cavities 69, and regions of the diaphragm 33 extend across the cavities 69 to divide each of the cavities 69 into expandable chambers 71 and 73, four sealed chambers 75, 75*a*, 75*b* and 75*c* (FIGS. 3 and 6), and into chambers where the check valves 35 and 37 are located. The expandable chambers 71 and 73 are sealed from each other and from the pumping chamber 31 by the beads 55 and 67 and by radial beads 77 (FIG. 5) which are also formed integrally with the diaphragm 33.

The housing section 21 has a plurality of posts 79 which are spaced apart to define channels which provide communication between the expandable chamber 71 and a region 81 (FIG. 2) of the inlet passage 39 immediately surrounding the post 64 and just upstream of the inlet check valve 35. Each of the posts 79 has a ledge 83 which engages the upper surface of the diaphragm 33. The construction at the outlet with respect to the expandable chamber 73 is identical, and corresponding portions are designated by corresponding reference numerals followed by the letter "a".

Although any suitable number of the sealed chambers can be utilized, in the embodiment illustrated, four of the separately sealed chambers 75–75*c* are employed, two for each of the expandable chambers 71 and 73. The sealed chambers 75–75*c* are sealed by the beads 56, 67 and 77 and by radial beads 87 adjacent the outlet.

Water passing through the inlet check valve 35 can travel into the pumping chamber 31 by a portion of the inlet passage 39 which comprises grooves 89 in the housing section 23 (FIGS. 2 and 6). Similarly, water can travel from the pumping chamber 31 to the outlet check valve 37 by a portion of the outlet passage 41 which comprises grooves 91 (FIGS. 2 and 6) which are also formed in the housing section 23. The grooves 89 and 91 extend between sealed chambers 75, 75*a*, and 75*b*, 75*c*, respectively.

In order to provide a pumping action, the pumping member 43 must be reciprocated axially within the pumping chamber 31. Although the function of powering the pump 27 can be carried out by many different power sources, in the embodiment illustrated, the actuator 29 is utilized. The actuator 29 may be identical to the actuator described in U.S. patent application Ser. No. 06/076,344 filed on Sept. 17, 1979 entitled Actuator and naming L. Clark Feightner and me as joint inventors. The actuator 29 is capable of driving the pumping member 43 through 60 cycles of reciprocation each second.

The actuator 29 includes electromagnetic means in the form of a core 93 suitably retained within the heat sink 19 and a coil 95 wound on the core (FIGS. 2 and 3). Ramps 97 and 97*a* are mounted in a groove 99 (FIG. 2) of the housing section 21 by fasteners 25. A leaf spring 101 is mounted on, and has its ends held in fixed position by, the fasteners 25. An armature 103 of magnetic material is mounted on the leaf spring 101 by a screw 105 which also attaches the armature and leaf spring to the shaft 47. The core 93 has a cavity 107 to allow the head of the screw 105 to move into close proximity to the core.

The armature 103 includes a plurality of plates 109 held together by rivets 111. The armature 103 has a concave surface 113 which faces away from the core 93 and which forms a segment of a cylinder.

The screw 105 and the shaft 47 cooperate to deform a central region of the leaf spring 101 into conformity with the concave surface 113. In the unstressed condition, the leaf spring 101 is planar and so, by deforming the leaf spring as shown in FIG. 3, the leaf spring is preloaded. This preloading enables the armature 103 to be very close to the core 93.

The ramps 97 and 97*a* have inclined ramp surfaces 115 and 115*a*, respectively, to progressively support increasing lengths of the leaf spring 101 as the latter is deflected upwardly as viewed in FIG. 3 toward the core 93. As this occurs, the effective length of the leaf spring 101 is progressively shortened, and this stiffens the leaf spring or increases its spring rate. To further increase the spring rate as the leaf spring 101 deflects toward the core 93, the area of the leaf spring as viewed in plan may progressively widen as it extends from the ends adjacent the fasteners 25 toward the armature 103.

By repeatedly energizing the coil 95, the electromagnetic force and the force from the leaf spring 101 cooperate to rapidly reciprocate the armature 103 and hence the pumping member 43. Specifically, energization of the coil 95 pulls the armature 103 toward the core 93 against the preloaded biasing force of the leaf spring 101. As the leaf spring 101 deflects, the ramp surfaces 115 and 115*a* (FIG. 3) progressively support increasing lengths of the leaf spring. Consequently, the effective length of the leaf spring 101 is progressively shortened to increase its spring rate. By the time the leaf spring 101 is deflected against the full lengths of the ramp surfaces 115 and 115*a*, the increased spring force virtually arrests movement of the armature 103. Thus, the spring 101 brings about termination at a precisely known point of the movement of the armature 103 toward the core 93. In this position, the ramp surfaces 115 and 115*a* form a smooth continuation of the concave surface 113.

When the coil 95 is de-energized, the electromagnetic force decays to allow the spring 101 to power the return stroke of the armature 103. Because the spring 101 operates above its preload range, strong forces are available to power the return stroke. In addition, when the initial position shown in FIG. 2 is reached, the spring force tending to move the armature 103 away from the core 93 instantly terminates so that overstroking is avoided. The coil 95 can be coupled to an ac source through a diode (not shown) so that the coil is energized, for example, 60 times each second.

When the coil 95 is energized, the pumping member 43 moves upwardly on its intake stroke and, when the coil 95 is de-energized, the leaf spring 101 pushes the pumping member 43 downwardly on its discharge stroke. On the intake stroke, the inlet check valve 35 is open and the outlet check valve 37 is closed. Water flows from the expandable chamber 71 and from the inlet 15 through the region 81 of the inlet passage 39, the inlet check valve 35 and the grooves 89 into the pumping chamber 31. During this time, the compressible gas in the sealed chambers 75 and 75*a* expands to shrink the expandable chamber 71 and force the water out of the expandable chamber and into the pumping chamber 31.

On the discharge stroke of the pumping member 43, the inlet check valve 35 closes and the outlet check valve 37 opens. During the discharge stroke, the inertia of the water column in the line or conduit (not shown) to which the inlet 15 is coupled supplies water to the expandable chamber 71, compresses the compressible gas in the sealed chambers 75 and 75*a*, and expands the expandable chamber 71. Also on the discharge stroke, the water is forced under pressure from the pumping chamber 31 through the grooves 91 (FIGS. 2 and 6), the outlet check valve 37 and the region 81*a* to the outlet 17. Simultaneously, water under pressure is forced into the expandable chamber 73 (FIGS. 3 and 5) to expand the expandable chamber 73 and compress the compressible gas in the sealed chambers 75*b* and 75*c*. On the next intake stroke, the compressible gas in the sealed chambers 75*b* and 75*c* expands to shrink the expandable chamber 73 and force the water out of the expandable chamber 73 and into the outlet 17. This tends to maintain a constant flow of water from the outlet 17.

It should be noted that the expandable chambers 71 and 73 are above the diaphragm 33 and that these chambers contain water. The actuator 29 is also above the diaphragm closely adjacent the expandable chambers 71 and 73. Thus, the water being pumped inherently cools the actuator 29.

Figure 4:
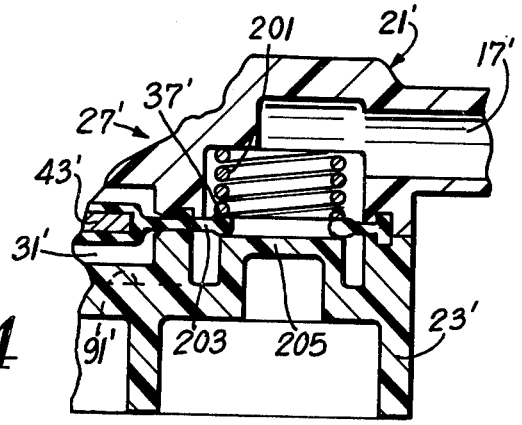
FIG. 4 is a fragmentary sectional view similar to a portion of FIG. 2 showing an alternate check valve construction.

FIG. 4 shows a pump 27' which is identical to the pump 27 in all respects not specifically shown or described herein. Portions of the pump 27' corresponding to portions of the pump 27 are designated by corresponding primed reference characters.

The pump 27' is substantially identical to the pump 27, except for the construction of the check valves. The pump 27' has an outlet check valve 37' which comprises a spring 201, a flexible annular section 203, and a valve seat 205 formed integrally with the housing section 23. The spring 201 biases the annular section 203 against the valve seat 205. On the discharge stroke of the pumping member 43', water is forced from the pumping chamber 31' through the grooves 91' and against the lower face of the annular section 203. This water pressure is sufficient to lift the flexible annular section 203 against the biasing action of the spring 201 to open the check valve 37' and allow the water to flow through the outlet 17'. Either or both of the inlet check valve and the outlet check valve may be constructed as shown in FIG. 4.

Although exemplary embodiments of the invention have been shown and described, many changes, modifications and substitutions may be made by one having ordinary skill in the art without necessarily departing from the spirit and scope of this invention.

I claim:

1. A pump for pumping a liquid comprising:

a housing having an inlet and an outlet, said housing including first and second housing sections and means for joining said first and second housing sections together;

a flexible diaphragm sandwiched between said first and second housing sections;

a pumping chamber in said housing;

said housing having an inlet passage leading from said inlet to the pumping chamber and an outlet passage leading from said pumping chamber to the outlet;

a positive displacement pumping member including a first portion of said diaphragm mounted for movement in said pumping chamber to pump the fluid from the inlet to the outlet;

inlet check valve means for allowing liquid to flow through the inlet passage to the pumping chamber and for substantially preventing liquid flow in the reverse direction through the inlet check valve means;

outlet check valve means for permitting liquid to flow from the pumping chamber through the outlet passage to the outlet and for substantially preventing liquid flow in the reverse direction through the outlet check valve means;

means defining a resiliently expandable chamber opening into the inlet passage upstream of the inlet check valve means to receive the liquid and to be resiliently expanded thereby; and a second portion of said diaphragm sealing the interface between said housing sections, said housing having a cavity therein, a third portion of said diaphragm extending across said cavity to divide said cavity into at least said expandable chamber and a sealed chamber, said sealed chamber having a compressible gas therein whereby the third portion of the diaphragm can be deformed against the compressible gas in the sealed chamber to permit the resilient expansion of the expandable chamber.

2. A pump as defined in claim 1 including means defining a second resiliently expandable chamber opening into said outlet passage downstream of said outlet check valve means to receive the liquid and to be resiliently expanded thereby.

3. A pump as defined in claim 1 including means on the same side of said diaphragm as the expandable chamber for driving said pumping member.

4. A pump as defined in claim 1 wherein said housing has a second cavity therein and a fourth portion of said diaphragm extends across said second cavity to divide said second cavity into at least a second expandable chamber and a second sealed chamber, said second expandable chamber opening into said outlet passage downstream of the outlet check valve means to receive liquid from the outlet passage and to be resiliently expanded by such liquid, said second sealed chamber having a compressible gas therein whereby the fourth portion of the diaphragm can be deformed against the compressible gas in the second sealed chamber to permit the resilient expansion of the second expandable chamber.

5. A pump as defined in claim 1 including a shaft coupled to said pumping member and projecting through an opening of the housing for driving the pumping member, said shaft and said opening being of noncircular cross-sectional configuration whereby the housing prevents rotation of the shaft.

6. A pump as defined in claim 1 including an actuator comprising an armature coupled to said pumping member, spring means for resiliently urging the armature in one direction to move the pumping member in said one direction within the pumping chamber, electromagnetic means energizable to apply a force to the armature to move the armature and the pumping member in the other direction against the biasing action of the spring, and means for progressively increasing the spring rate of the spring as the armature is moved by the electromagnetic means.

7. A pump as defined in claim 1 wherein at least one of said check valve means includes a valve seat, said pump includes at least one projection on one of the diaphragm and the valve seat and at least one recess on the other of the diaphragm and the valve seat, and said projection is received in said recess to mount the valve seat on the diaphragm.

8. A pump for pumping a liquid comprising:

a housing having an inlet and an outlet, said housing including first and second housing sections and means for interconnecting said first and second housing sections;

a diaphragm sandwiched between said first and second housing sections;

a pumping chamber in said housing;

said housing having an inlet passage leading from said inlet to the pumping chamber and an outlet passage leading from said pumping chamber to the outlet;

a positive displacement pumping member mounted for movement in said pumping chamber to pump the fluid from the inlet to the outlet;

inlet check valve means for allowing liquid to flow through the inlet passage to the pumping chamber and for substantially preventing liquid flow in the reverse direction through the inlet check valve means;

outlet check valve means for permitting liquid to flow from the pumping chamber through the outlet passage to the outlet and for substantially preventing liquid flow in the reverse direction through the outlet check valve means;

means defining a resiliently expandable chamber opening into the inlet passage upstream of the inlet check valve means to receive the liquid and to be resiliently expanded thereby; and at least one of said check valve means including a valve seat, and at least one projection on one of the diaphragm and the valve seat and at least one recess on the other of the diaphragm and the valve seat, said projection being received in said recess to mount the valve seat on the diaphragm.

9. A pump as defined in claim 8 wherein each of said check valve means includes a valve seat and a valve element, said valve seats being substantially identical and said valve elements being substantially identical, each of said valve elements being mounted on the associated valve seat, means for mounting the other of said valve seats on the diaphragm, and said housing including means for preventing the installation of each of said check valve means in a reverse manner so that it would not block flow in the correct direction.

* * * * *